United States Patent [19]

Puresevic et al.

[11] Patent Number: 4,801,028

[45] Date of Patent: Jan. 31, 1989

[54] CLOSURE DEVICE FOR A CONTAINER HAVING A CYLINDRICAL OPENING

[75] Inventors: Peter J. Puresevic, Tonteg; Julian D. Taylor, Pwllypant, both of Wales

[73] Assignee: Spectra King Precision Engineers Limited, England

[21] Appl. No.: 914,878

[22] Filed: Oct. 3, 1986

[51] Int. Cl.[4] ..... B65D 55/02

[52] U.S. Cl. ..... 215/220; 215/203

[58] Field of Search ..... 215/220, 219, 230

[56] References Cited

U.S. PATENT DOCUMENTS

| | | | |
|---|---|---|---|
| 4,489,841 | 12/1984 | Thompson | 215/230 |
| 4,527,701 | 7/1985 | Schaubeck | 215/220 |
| 4,555,036 | 11/1985 | Bekkers et al. | 215/220 |
| 4,669,620 | 6/1987 | Coifman | 215/220 |

*Primary Examiner*—George T. Hall

*Attorney, Agent, or Firm*—Lowe, Price, LeBlanc, Becker & Shur

[57] ABSTRACT

The invention relates to a safety closure device 1 for a container, the device including an inner and an outer cap coacting together. On initial depression of the outer cap 3 of the device when on a neck of a container, the lower (as viewed) surface of a frangible disc 18 in the outer cap bears on the upper surfaces (as viewed) of a boss 17 on the inner cap. The boss has a greater diameter than the disc 18 but a smaller diameter than a circular aperture in the outer cap 3 in which the disc 18 is situated. The boss 17 rides into the aperture when pressure is applied to the outer cap, bearing on lugs 19 and 20 holding disc 18 and rupturing them; the pressure being considerably increased where the lugs bear on the sharp edge of the boss at the transition from the uppermost surface to the boundary wall thereof. The disc 18 is released when lugs 19 and 20 rupture, to "spring" out of the aperture and away from the closure device leaving a circular hole behind. This indicates that operation of the device to remove it from the container had been effected or attempted, and the effect is enhanced by selection of different colors for the two caps. A seal 21 of the inner cap provides a can flex to accommodate to any shape of mouth of the opening, including cases where the outer edge thereof is angled or curved toward the center.

2 Claims, 1 Drawing Sheet

CLOSURE DEVICE FOR A CONTAINER HAVING A CYLINDRICAL OPENING

TECHNICAL FIELD OF THE INVENTION

The invention relates to a closure device for a container having a cylindrical opening.

BACKGROUND ART

Generally, closure devices such as screw-threaded caps of containers with screw-threaded openings such as a neck can be removed relatively easily by unscrewing. This can be dangerous when the container houses drugs, dangerous chemicals and the like and a child, for example, unscrews the closure device and gains access to the contents and then takes the contents with possibly harmful or even fatal results.

Closure devices which seek to provide for safer or authorized opening of the container have been proposed, but they are generally complex and expensive.

DISCLOSURE OF THE INVENTION

It is an object of the invention to seek to mitigate these disadvantages of prior closures for containers.

According to one aspect of the invention there is provided a closure device for a container having a cylindrical opening, comprising inner and outer closure members each comprising an end member and a skirt member, which closure members are rotatable in unison to release the device from an opening to which it is applied, in use, on application of substantially axial pressure on the outer member, and means to indicate that such operation of the device has been effected or attempted.

According to a second aspect of the invention there is provided a closure device for a container having a cylindrical opening, comprising inner and outer closure members each comprising an end member and skirt member, and first and second drive means, the first drive means being between the respective skirt members and being operative to rotate the closure members in unison in one sense only, the second drive means being associated with means biassing the inner and outer members axially apart and being operative to rotate the closure members in unision in the opposite sense only when pressure is applied to the outer member in the axial direction sufficiently to overcome the pressure of the biassing means to move the outer member towards the inner member and the outer member is rotated in the opposite sense, and means to indicate that such operation of the device has been effected or attempted.

The indicating means may comprise a frangible part of the outer closure member. This provides a positive indication of such operation.

The frangible part may comprise a circular part such as a disc portion of the end member of the outer closure member.

The inner member may have a boss aligned with the disc and acting thereon to rupture a frangible connection by which the disc may be connected to the end member of the inner member.

There may be two or more frangible connections.

The indicating means may comprise color indicator of such operation.

The inner closure member may comprise a seal for sealing in use the cylindrical opening to which the device is applied.

The seal may comprise a resilient flange extending from the end member of the inner closure member towards the skirt member thereof.

The flange may terminate short of the skirt member of the inner closure member.

It will be understood that the invention extends to a container having a screw-threaded cylindrical opening and a closure device, as hereinbefore defined, in which the inner surface of the skirt of the inner cylindrical closure member has a screw thread which mates, or can mate, with the screw-threaded cylindrical opening.

A safety closure device, for the externally screw-threaded neck of a bottle is hereinafter described, by way of example, with reference to the accompanying drawings.

DESCRIPTION OF THE PREFERRED EMBODIMENTS

Figure 1:
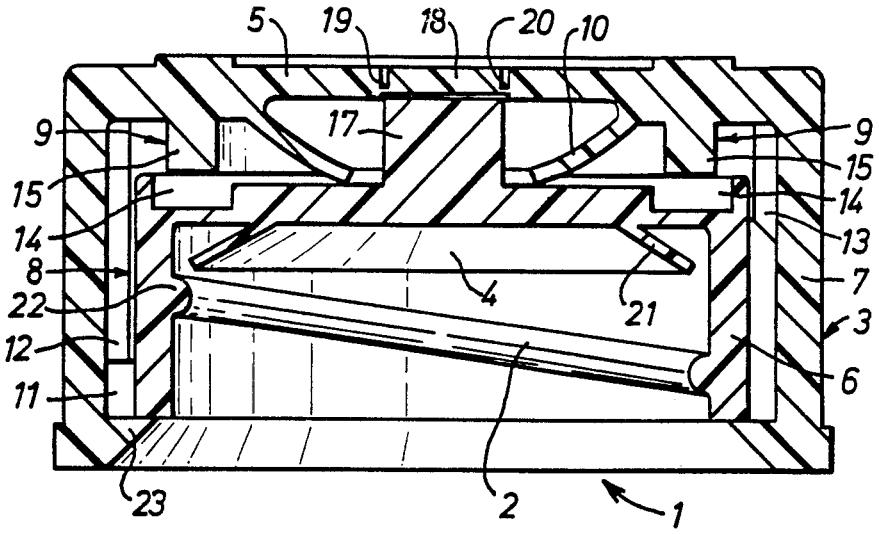
FIG. 1 shows a longitudinal sectional view of the closure device.

Referring to the drawings, the closure device 1 comprises inner and outer cylindrical closure members 2 and 3 each comprising, respectively, an end member 4 and 5 and a skirt member 6 and 7 and first and second drive means 8 and 9, the first drive means 8 being between the skirt members 6 and 7, the second drive means 9 being associated with biassing means in the form of a resilient member or ring 10 which biasses the inner and outer members 2 and 3 axially apart (upwardly as viewed).

The inner cylindrical closure member or cap 2 is smaller on its outer diameter than the inner diameter of the outer cylindrical closure member or cap 3, so there is a gap 11 between the two caps in which the first drive means 8 is situated. The first drive means 8 for turning the two caps 2 and 3 in unison in one sense to tighten the closure device 1 on the neck (not shown) comprises four equally circumferentially spaced apart ratchets 12 on the outer (as viewed) surface of the skirt 6 and four driving dogs 13 equidistantly circumferentially spaced apart on the inner (as viewed) surface of the skirt 7.

The second drive means 9 comprises eight equidistantly spaced apart sockets 14 carried by the outer surface of the end member 4 of the cap 2 and two diametrically opposed dogs 15 which are of generally triangular section with a flat 16 and which project from the inner surface of the end member 5 of the outer cylindrical cap 3.

The ring 10 is of smaller diameter than the diametrical spacing of the drive dogs 15 and has greater height that dogs 15, so that the inner and outer caps 2 and 3 are spaced apart with the drive dogs 15 out of engagement with the sockets 14.

The outer surface of the end member 4 of the cap 2 has an upstanding boss 17 which is axially aligned with a frangible part 18 of the end member 5 of the cap 3, the frangible part 18 being in the form of a circular disc which is spaced from the surrounding part of the end member 5 and is connected therewith by a frangible connection in the form of two diametrically opposed lugs 19 and 20. The boss 17 and disc 18 form means to indicate that operation of the closure device 1 to remove it from a cylindrical opening has been effected or attempted.

The inner surface of the end member 4 of the cap 2 has a seal 21 which is in the form of a resilient circular flange which is inclined away from the longitudinal axis of the closure device towards the skirt member 6 and terminate short thereof.

Each cap 2 and 3 is injection moulded as a separate integral unit, the inner surface of the skirt 6 having a screw thread 22 formed thereon during moulding. Polypropylene is the preferred plastics material for this purpose. The inner cap 2 is made of plastics of a different colour from from that of the cap 3. Thus the cap 2 may be red and the cap 3 white.

The two caps 2 and 3 are force-fitted together so that they assume the assembled condition shown in the drawings. The inner cap springs past a circumferential lip 23 on the outer cap 3 on assembly and anti-removal means in the form of four detents 24 on the inner cap to prevent it from springing out of the outer cap 3 past the lip 23 after assembly.

Figure 2:
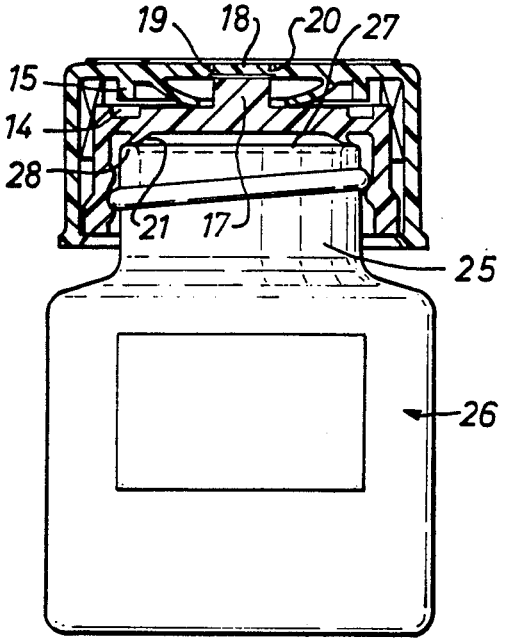
FIG. 2 shows the closure device in position on a container such as a drugs or pill bottle.
Figure 3:
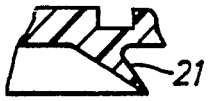
FIG. 3 shows an enlarged fragmentary part of FIG. 2.
Figure 4:
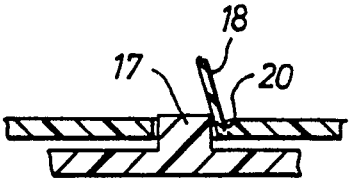
FIG. 4 shows part of the device after opening.

In order to tighten the closure device 1 on the screw-threaded neck 25 of a bottle 26 such as a medicine bottle (FIGS. 2,3) the closure device 1 is offered up to the neck 25 and the screw threads engage when the outer cap 3 is turned in one sense, clockwise, to effect tightening. This turning causes the drive dogs 13 to engage the free edges of the ratchets 12 so that both inner and outer caps 2 and 3 turn in unison in the tightening direction.

If the outer cap 3 is now rotated in the opposite sense, in the anti-clockwise or tightening direction, the drive dogs 13 merely click over the ratchets 12, which are resilient. The closure device 1 remains firmly in place on the neck 25. In order to remove the closure device 1 from the neck, it is necessary to depress the outer cap 3 axially so that the pressure of the ring 10 urging the caps 2 and 3 apart is overcome, the depression being sufficient to engage the drive dogs 15 in the sockets 14. On turning the outer cap 3 the inner cap 2 now turns with it so the two can be rotated in unison and removed from the neck. When the applied pressure is removed the resilient ring 10 urges the two caps 2 and 3 axially apart again so that the drive dogs 15 and sockets 14 disengage, ready for re-assembly of the closure device 1 with the neck as described.

However, on the initial depression of the outer cap 3, the lower (as viewed) surface of the disc 18 bears on the upper surface (as viewed) on the boss 17, which boss has a greater diameter than the disc 18 but a smaller diameter than the circular aperture in the end member 5 in which the disc 18 is situated.

The boss 17 thus effectively rides into the aperture, bearing on the lugs 19 and 20 and rupturing them, the pressure being considerably increased where the lugs bear on the sharp edge of the lug at the transition from the upper surface to the boundary wall thereof.

The disc 18 is now released and, when the lugs 19 and 20 rupture, tends to "spring" out of the aperture and away from the closure device, thus leaving a circular hole behind. This would be enough to indicate that operation of the device to remove it from the container had been effected or attempted, but the effect is enhanced by the red color of the boss showing through the aperture in contrast to the white of the outer cap 3, these being merely exemplary colors.

When the device 1 is in position on the container, the seal 21 provides a comprehensive seal of the opening 27 as it can flex to accommodate any shape of mouth of the opening, including where the outer edge 28 thereof is angled or curved towards the centre.

It will be understood that the invention above described and shown in the drawings may be modified. For example, the boss may have a diameter equal to or less than the diameter of the disc. Also, the boss and disc may be of different configurations, for example, hexagonal and circular respectfully. Also, the frangible connection may comprise a relatively thin membrane rather than the two lugs 19 and 20 shown. The lug may be the only part which is of a different colour, or both caps 2 and 3 may be of the same colour.

The closure device referred to may be made to fit any standard container or bottle. No special container or bottle is required.

We claim:

1. A closure device for a container having a cylindrical opening, comprising:

inner and outer closure members each comprising an end member and a skirt member and first and second drive means for driving of said inner closure member by said outer closure member, the first drive means being disposed between the respective skirt members and being operative to rotate the closure members in unison in one sense only, the second drive means being associated with means for biassing the inner and outer members axially apart and being operative to rotate said closure members in unison in the opposite sense only when pressure is applied to the outer member in the axial direction sufficiently to overcome the force of the biassing means to move the outer member towards the inner member and the outer member is rotated in the opposite sense, and means for indicating that such operation of the device has been effected or attempted, said indicating means comprising a frangible part of the outer closure member which is joined to the remainder thereof by frangible connections and a boss disposed on the inner closure member to act on the connections to break the same when said axial pressure is applied, thereby to separate the frangible part from the outer closure member, wherein the inner closure member comprises a seal for sealing in use the cylindrical opening to which the device is applied, and the seal comprises a resilient flange extending from the end member of the inner closure member towards the skirt member thereof.

2. A device according to claim 1, wherein:

the flange terminates short of the skirt member of the inner closure member.

* * * * *